US007637580B2

(12) United States Patent
Shamoun et al.

(10) Patent No.: US 7,637,580 B2
(45) Date of Patent: Dec. 29, 2009

(54) METHODS AND APPARATUS FOR A HIGH RESOLUTION INKJET FIRE PULSE GENERATOR

(75) Inventors: Bassam Shamoun, Fremont, CA (US); Eugene Mirro, Portland, OR (US); Janusz Jozwiak, San Ramon, CA (US); Quanyuan Shang, Saratoga, CA (US); Shinichi Kurita, San Jose, CA (US); John M. White, Hayward, CA (US)

(73) Assignee: Applied Materials, Inc., Santa Clara, CA (US)

( * ) Notice: Subject to any disclaimer, the term of this patent is extended or adjusted under 35 U.S.C. 154(b) by 310 days.

(21) Appl. No.: 11/238,637

(22) Filed: Sep. 29, 2005

(65) Prior Publication Data

US 2006/0109290 A1 May 25, 2006

(51) Int. Cl.
*B41J 29/38* (2006.01)

(52) U.S. Cl. ..... 347/9; 347/11

(58) Field of Classification Search ..... 347/9, 347/11

See application file for complete search history.

(56) References Cited

U.S. PATENT DOCUMENTS

| | | | |
|---|---|---|---|
| 4,571,601 | A | 2/1986 | Teshima |
| 4,987,043 | A | 1/1991 | Roosen et al. |
| 5,114,760 | A | 5/1992 | Takemura et al. |
| 5,177,627 | A | 1/1993 | Ishiwata et al. |
| 5,232,634 | A | 8/1993 | Sawada et al. |
| 5,232,781 | A | 8/1993 | Takemura et al. |
| 5,264,952 | A | 11/1993 | Fukutani et al. |
| 5,340,619 | A | 8/1994 | Chen et al. |
| 5,399,450 | A | 3/1995 | Matsushima et al. |
| 5,432,538 | A | 7/1995 | Carlotta |
| 5,552,192 | A | 9/1996 | Kashiwazaki et al. |
| 5,554,466 | A | 9/1996 | Matsushima et al. |
| 5,593,757 | A | 1/1997 | Kashiwazaki et al. |
| 5,626,994 | A | 5/1997 | Takayanagi et al. |
| 5,648,198 | A | 7/1997 | Shibata |
| 5,702,776 | A | 12/1997 | Hayase et al. |
| 5,705,302 | A | 1/1998 | Ohno et al. |
| 5,714,195 | A | 2/1998 | Shiba et al. |
| 5,716,739 | A | 2/1998 | Kashiwazaki et al. |

(Continued)

FOREIGN PATENT DOCUMENTS

| | | | |
|---|---|---|---|
| CN | 1160213 | A | 9/1997 |

(Continued)

*Primary Examiner*—Julian D Huffman
(74) *Attorney, Agent, or Firm*—Dugan & Dugan PC

(57) ABSTRACT

The invention provides methods, systems, and drivers for controlling an inkjet printing system. The driver may include logic including a processor, memory coupled to the logic, and a fire pulse generator circuit coupled to the logic. The fire pulse generator may include a connector to facilitate coupling the driver to a print head. The fire pulse generator circuit may also include a fixed current source circuit adapted to generate a fire pulse with a constant slew rate that facilitates easy adjustment of ink drop size. The logic is adapted to receive an image and to convert the image to an image data file. The image data file is adapted to be used by the driver to trigger the print head to deposit ink into pixel wells on a substrate as the substrate is moved in a print direction. Numerous other aspects are disclosed.

18 Claims, 7 Drawing Sheets

U.S. PATENT DOCUMENTS

| | | | |
|---|---|---|---|
| 5,716,740 | A | 2/1998 | Shiba et al. |
| 5,726,724 | A | 3/1998 | Shirota et al. |
| 5,729,259 | A | 3/1998 | Gotoh et al. |
| 5,748,266 | A | 5/1998 | Kodate |
| 5,757,387 | A | 5/1998 | Manduley |
| 5,811,209 | A | 9/1998 | Eida et al. |
| 5,817,441 | A | 10/1998 | Iwata et al. |
| 5,831,704 | A | 11/1998 | Yamada et al. |
| 5,847,735 | A | 12/1998 | Betschon |
| 5,880,799 | A | 3/1999 | Inoue et al. |
| 5,895,692 | A | 4/1999 | Shirasaki et al. |
| 5,916,713 | A | 6/1999 | Ochiai et al. |
| 5,916,735 | A | 6/1999 | Nakashima et al. |
| 5,922,401 | A | 7/1999 | Kashiwazaki et al. |
| 5,948,576 | A | 9/1999 | Shirota et al. |
| 5,948,577 | A | 9/1999 | Nakazawa et al. |
| 5,956,063 | A | 9/1999 | Yokoi et al. |
| 5,962,581 | A | 10/1999 | Hayase et al. |
| 5,968,688 | A | 10/1999 | Masuda et al. |
| 5,969,780 | A | 10/1999 | Matsumoto et al. |
| 5,984,470 | A | 11/1999 | Sakino et al. |
| 5,989,757 | A | 11/1999 | Satoi |
| 6,013,415 | A | 1/2000 | Sakurai et al. |
| 6,025,898 | A | 2/2000 | Kashiwazaki et al. |
| 6,025,899 | A | 2/2000 | Fukunaga et al. |
| 6,042,974 | A | 3/2000 | Iwata et al. |
| 6,063,527 | A | 5/2000 | Nishikawa et al. |
| 6,066,357 | A | 5/2000 | Tang et al. |
| 6,071,989 | A | 6/2000 | Sieber et al. |
| 6,078,377 | A | 6/2000 | Tomono et al. |
| 6,087,196 | A | 7/2000 | Sturm et al. |
| 6,106,093 | A | 8/2000 | Nagoshi |
| 6,134,059 | A | 10/2000 | Shirota et al. |
| 6,140,988 | A | 10/2000 | Yamada |
| 6,142,604 | A | 11/2000 | Kanda et al. |
| 6,145,981 | A | 11/2000 | Akahira et al. |
| 6,149,257 | A | 11/2000 | Yanaka et al. |
| 6,153,711 | A | 11/2000 | Towns et al. |
| 6,154,227 | A | 11/2000 | Lund |
| 6,158,858 | A | 12/2000 | Fujiike et al. |
| 6,162,569 | A | 12/2000 | Nakashima et al. |
| 6,179,400 | B1 | 1/2001 | Akahira et al. |
| 6,196,663 | B1 | 3/2001 | Wetchler et al. |
| 6,211,347 | B1 | 4/2001 | Sieber et al. |
| 6,224,205 | B1 | 5/2001 | Akahira et al. |
| 6,226,067 | B1 | 5/2001 | Nishiguchi et al. |
| 6,228,435 | B1 | 5/2001 | Yoshikawa et al. |
| 6,234,626 | B1 | 5/2001 | Axtell et al. |
| 6,242,139 | B1 | 6/2001 | Hedrick et al. |
| 6,244,702 | B1 | 6/2001 | Sakino et al. |
| 6,264,322 | B1 | 7/2001 | Axtell et al. |
| 6,270,930 | B1 | 8/2001 | Okabe |
| 6,271,902 | B1 | 8/2001 | Ogura et al. |
| 6,277,529 | B1 | 8/2001 | Marumoto et al. |
| 6,281,960 | B1 | 8/2001 | Kishimoto et al. |
| 6,312,771 | B1 | 11/2001 | Kashiwazaki et al. |
| 6,322,936 | B1 | 11/2001 | Nishikawa et al. |
| 6,323,921 | B1 | 11/2001 | Kurauchi et al. |
| 6,331,384 | B1 | 12/2001 | Satoi |
| 6,341,840 | B1 | 1/2002 | van Doorn et al. |
| 6,344,301 | B1 | 2/2002 | Akutsu et al. |
| 6,356,357 | B1 | 3/2002 | Anderson et al. |
| 6,358,602 | B1 | 3/2002 | Horiuchi et al. |
| 6,367,908 | B1 | 4/2002 | Serra et al. |
| 6,384,528 | B1 | 5/2002 | Friend et al. |
| 6,384,529 | B2 | 5/2002 | Tang et al. |
| 6,386,675 | B2 | 5/2002 | Wilson et al. |
| 6,392,728 | B2 | 5/2002 | Tanaka et al. |
| 6,392,729 | B1 | 5/2002 | Izumi et al. |
| 6,399,257 | B1 | 6/2002 | Shirota et al. |
| 6,417,908 | B2 | 7/2002 | Nishiguchi et al. |
| 6,424,393 | B1 | 7/2002 | Hirata et al. |
| 6,424,397 | B1 | 7/2002 | Kuo |
| 6,426,166 | B2 | 7/2002 | Nishikawa et al. |
| 6,428,135 | B1 | 8/2002 | Lubinsky et al. |
| 6,428,151 | B1 | 8/2002 | Yi et al. |
| 6,429,601 | B1 | 8/2002 | Friend et al. |
| 6,429,916 | B1 | 8/2002 | Nakata et al. |
| 6,433,852 | B1 | 8/2002 | Sonoda et al. |
| 6,450,635 | B1 | 9/2002 | Okabe et al. |
| 6,455,208 | B1 | 9/2002 | Yamashiki et al. |
| 6,462,798 | B1 | 10/2002 | Kim et al. |
| 6,464,329 | B1 | 10/2002 | Koitabashi et al. |
| 6,464,331 | B1 | 10/2002 | Van Doorn et al. |
| 6,468,702 | B1 | 10/2002 | Yi et al. |
| 6,471,352 | B2 | 10/2002 | Akahira |
| 6,475,271 | B2 | 11/2002 | Lin |
| 6,476,888 | B2 | 11/2002 | Yamanashi |
| 6,480,253 | B1 | 11/2002 | Shigeta et al. |
| 6,498,049 | B1 | 12/2002 | Friend et al. |
| 6,500,485 | B1 | 12/2002 | Yamaguchi et al. |
| 6,508,533 | B2 | 1/2003 | Tsujimoto et al. |
| 6,518,700 | B1 | 2/2003 | Friend et al. |
| 6,557,984 | B2 | 5/2003 | Tanaka et al. |
| 6,569,706 | B2 | 5/2003 | Pakbaz et al. |
| 6,580,212 | B2 | 6/2003 | Friend |
| 6,582,048 | B1 | 6/2003 | Akahira et al. |
| 6,627,364 | B2 | 9/2003 | Kiguchi et al. |
| 6,630,274 | B1 | 10/2003 | Kiguchi et al. |
| 6,667,795 | B2 | 12/2003 | Shigemura |
| 6,686,104 | B1 | 2/2004 | Shiba et al. |
| 6,692,983 | B1 | 2/2004 | Chen et al. |
| 6,693,611 | B1 | 2/2004 | Burroughes |
| 6,695,905 | B2 | 2/2004 | Rozumek et al. |
| 6,698,866 | B2 | 3/2004 | Ward et al. |
| 6,705,694 | B1 | 3/2004 | Barbour et al. |
| 6,738,113 | B2 | 5/2004 | Yu et al. |
| 6,762,234 | B2 | 7/2004 | Grizzi |
| 7,271,824 | B2 | 9/2007 | Omori et al. |
| 7,412,272 | B2 | 8/2008 | Shamoun et al. |
| 2001/0012596 | A1 | 8/2001 | Kunimoto et al. |
| 2002/0054197 | A1 | 5/2002 | Okada et al. |
| 2002/0081376 | A1 | 6/2002 | Yonehara |
| 2002/0128515 | A1 | 9/2002 | Ishida et al. |
| 2003/0025446 | A1 | 2/2003 | Lin et al. |
| 2003/0030715 | A1 | 2/2003 | Cheng et al. |
| 2003/0039803 | A1 | 2/2003 | Burroughes |
| 2003/0076454 | A1 | 4/2003 | Burroughes |
| 2003/0117455 | A1 | 6/2003 | Bruch et al. |
| 2003/0118921 | A1 | 6/2003 | Chen et al. |
| 2003/0171059 | A1 | 9/2003 | Kawase et al. |
| 2003/0189604 | A1 | 10/2003 | Bae et al. |
| 2003/0218645 | A1 | 11/2003 | Dings et al. |
| 2003/0222927 | A1 | 12/2003 | Koyama |
| 2003/0224621 | A1 | 12/2003 | Ostergard et al. |
| 2004/0008243 | A1 | 1/2004 | Sekiya |
| 2004/0018305 | A1 | 1/2004 | Pagano et al. |
| 2004/0023567 | A1 | 2/2004 | Koyama et al. |
| 2004/0041155 | A1 | 3/2004 | Grzzi et al. |
| 2004/0075383 | A1 | 4/2004 | Endo et al. |
| 2004/0075789 | A1 | 4/2004 | Wang |
| 2004/0086631 | A1 | 5/2004 | Han et al. |
| 2004/0094768 | A1 | 5/2004 | Yu et al. |
| 2004/0097101 | A1 | 5/2004 | Kwong et al. |
| 2004/0097699 | A1 | 5/2004 | Holmes et al. |
| 2004/0104951 | A1 | 6/2004 | Shibata et al. |
| 2004/0109051 | A1 | 6/2004 | Bright et al. |
| 2004/0125181 | A1 | 7/2004 | Nakamura |
| 2004/0218002 | A1 | 11/2004 | Nakamura |
| 2005/0041073 | A1* | 2/2005 | Fontaine et al. ..... 347/9 |
| 2005/0057599 | A1 | 3/2005 | Takenaka et al. |
| 2005/0083364 | A1 | 4/2005 | Billow |
| 2006/0092204 | A1 | 5/2006 | White et al. |
| 2006/0092436 | A1 | 5/2006 | White et al. |

| | | | |
|---|---|---|---|
| 2006/0109296 | A1 | 5/2006 | Shamoun et al. |
| 2007/0042113 | A1 | 2/2007 | Ji |
| 2007/0182775 | A1 | 8/2007 | Kurita |
| 2008/0024552 | A1 | 1/2008 | White |

FOREIGN PATENT DOCUMENTS

| | | | | |
|---|---|---|---|---|
| CN | 1162749 | A | | 10/1997 |
| DE | 1218473 | | | 6/1966 |
| EP | 0 675 385 | A1 | | 10/1995 |
| EP | 1 106 360 | A1 | | 6/2001 |
| JP | 59-075205 | | | 4/1984 |
| JP | 61-245106 | | | 10/1986 |
| JP | 63-235901 | | | 9/1988 |
| JP | 63-294503 | | | 12/1988 |
| JP | 01-277802 | | | 11/1989 |
| JP | 02-173703 | | | 7/1990 |
| JP | 02-173704 | | | 7/1990 |
| JP | 06-340094 | | | 12/1994 |
| JP | 07-198924 | | | 8/1995 |
| JP | 08-160219 | | | 6/1996 |
| JP | 10-039130 | | | 2/1998 |
| JP | 10-073813 | | | 3/1998 |
| JP | 10-202861 | | * | 4/1998 |
| JP | 2002-277622 | | | 9/2002 |
| JP | 2003-303544 | | | 10/2003 |
| JP | 2004-077681 | | | 3/2004 |
| KR | 2004-0020902 | | | 3/2004 |
| WO | WO 02/14076 | A1 | | 2/2002 |
| WO | WO 03/022590 | | | 3/2003 |
| WO | WO 03/045697 | A1 | | 6/2003 |

* cited by examiner

METHODS AND APPARATUS FOR A HIGH RESOLUTION INKJET FIRE PULSE GENERATOR

CROSS REFERENCE TO RELATED APPLICATIONS

The present application is related to U.S. patent application Ser. No. 11/061,148, filed on Feb. 18, 2005 and entitled "METHODS AND APPARATUS FOR INKJET PRINTING OF COLOR FILTERS FOR DISPLAYS" which is hereby incorporated by reference herein in its entirety.

The present application is also related to U.S. Provisional Patent Application Ser. No. 60/625,550, filed Nov. 4, 2004 and entitled "APPARATUS AND METHODS FOR FORMING COLOR FILTERS IN A FLAT PANEL DISPLAY BY USING INKJETTING" which is hereby incorporated by reference herein in its entirety.

The present application is also related to U.S. patent application Ser. No. 11/061,120, filed on Feb. 18, 2005 and entitled "METHODS AND APPARATUS FOR PRECISION CONTROL OF PRINT HEAD ASSEMBLIES" which is hereby incorporated by reference herein in its entirety.

CROSS REFERENCE TO RELATED APPLICATIONS

The present application is related to U.S. patent application Ser. No. 11/238,632, filed on Sep. 29, 2005 and entitled "METHODS AND APPARATUS FOR INKJET PRINTING COLOR FILTERS FOR DISPLAYS" which is hereby incorporated by reference herein in its entirety.

FIELD OF THE INVENTION

The present invention relates generally to systems for printing color filters for flat panel displays, and is more particularly concerned with systems and methods for generating a high resolution inkjet fire pulse.

BACKGROUND OF THE INVENTION

The flat panel display industry has been attempting to employ inkjet printing to manufacture display devices, in particular, color filters. One problem with effective employment of inkjet printing is that it is difficult to inkjet ink or other material accurately and precisely on a substrate while having high throughput. Accordingly, methods and apparatus are needed to efficiently convert an electronic image into data that can be used to effectively and precisely drive a printer control system.

SUMMARY OF THE INVENTION

In a certain aspects, the present invention provides a circuit for generating a fire pulse that includes a first input adapted to receive a first control signal, a second input adapted to receive a second control signal, a first fixed current source coupled to and controlled by the first input, a second fixed current source coupled to and controlled by the second input, and an output terminal coupled to the first fixed current source and the second fixed current source.

In other aspects, the present invention provides a system for generating a fire pulse that includes logic including a processor, a memory coupled to the logic, and a fire pulse generator circuit coupled to the logic. The fire pulse generator circuit includes a first input adapted to receive a first control signal from the logic, a second input adapted to receive a second control signal from the logic, a first fixed current source coupled to and controlled by the first input, a second fixed current source coupled to and controlled by the second input, and an output terminal coupled to the first fixed current source and the second fixed current source.

In yet other aspects, the present invention provides a method of generating a fire pulse that includes receiving a first control signal at a first input, receiving a second control signal at a second input, controlling a first fixed current source coupled to the first input in response to the first control signal, controlling a second fixed current source coupled to the second input in response to the second control signal, and outputting a fire pulse to an output terminal coupled to the first fixed current source and the second fixed current source.

Other features and aspects of the present invention will become more fully apparent from the following detailed description, the appended claims and the accompanying drawings.

DETAILED DESCRIPTION

Figure 1A:
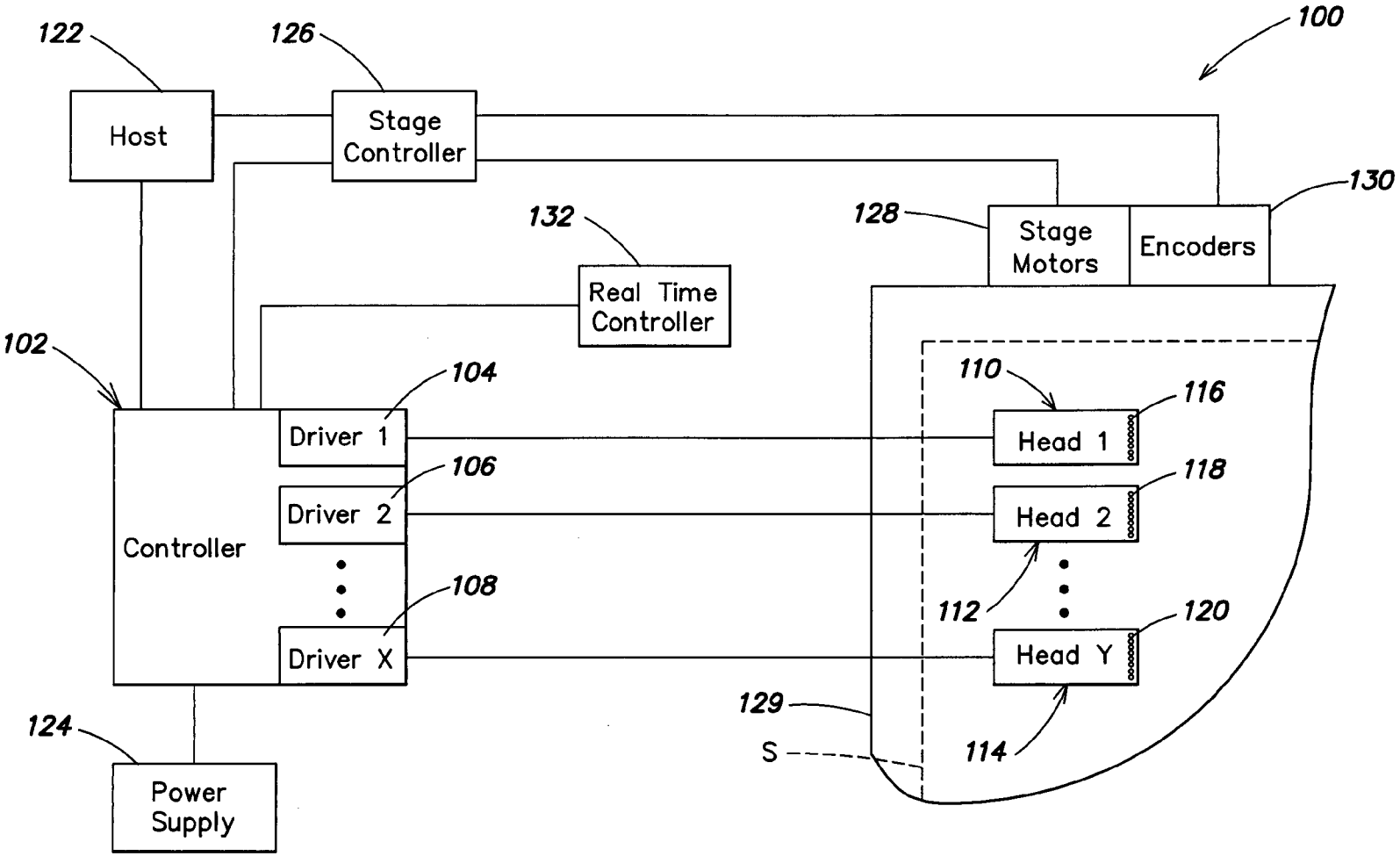
FIG. 1A is a schematic illustration of an inkjet print system according to some embodiments of the present invention.

Inkjet printers frequently make use of one or more inkjet print heads mounted within carriages such that a substrate, such as glass, may be passed below the print heads to print a color filter for a flat panel display. As the substrate travels relative to the heads, an inkjet printer control system activates individual nozzles within the heads to deposit or eject ink (or other fluid) droplets onto the substrate to form images.

Activating a nozzle may include sending a fire pulse signal or pulse voltage to the individual nozzle to cause an ejection mechanism to dispense a quantity of ink related to the amplitude of the fire pulse. In some print heads, the pulse voltage is used to trigger, for example, a piezoelectric element that pushes or "jets" ink out of the nozzle. In other heads the pulse voltage causes a laser to irradiate a membrane that, in response to the laser light, pushes ink out of the nozzle. Other methods may be employed.

The present invention provides systems, methods and apparatus for generating a fire pulse with a fixed slew rate that allows precise, linear control of an amount of ink that is to be jetted. The present invention further allows an inkjet printer to accurately vary the amount of ink to be jetted while printing.

The inventors of the present invention observed that prior art fire pulse generator circuits produce a fire pulse that has a profile with variable slew rates. A variable slew rate results in a non-linear relationship between the input signals (into the prior art fire pulse generator circuit) and the amount of ink that is jetted. Thus, ink drop size is difficult to accurately control or adjust using such circuits. While this may be acceptable in relatively low resolution printers that rely on using a fixed drop size, a high resolution printer according to the present invention may advantageously adjust drop size to precisely match the most desirable drop size for any given color filter design. The present inventors determined that the prior art fire pulse circuits relied upon an RC circuit to produce a fire pulse and that this is what caused the variable slew rate. However, it was determined that by using a fixed current source to produce the fire pulse, instead of an RC circuit, the fire pulse generator of the present invention is able to create a fire pulse with a fixed slew rate that allows precise, linear control of the amount of ink that is to be jetted.

Thus, a print system according to the present invention may efficiently and accurately deposit fluid on a substrate to print color filters with high resolution. The system of the present invention facilitates improved dimensional precision of ink dispensed within pixel wells of a color filter for a display panel. This is achieved by mapping fluid quantity control information into data that represents the image to be printed. For example, drop position data that is a representation of a raw image is used to generate variable amplitude fire pulse voltage signals that are used to trigger the nozzles of print head assemblies to dispense ink drops inside pixel wells of color filters used in the manufacture of display objects.

Turning to FIG. 1A, a schematic illustration of an example embodiment of an inkjet print system 100 is provided. An inkjet print system 100 may include a controller 102 that includes logic, communication, and memory devices. The controller 102 may alternatively or additionally include one or more drivers 104, 106, 108 that may each include logic to transmit control signals (e.g., fire pulse signals) to one or more print heads 110, 112, 114. The print heads 110, 112, 114, may include one or more nozzles 116, 118, 120 for depositing fluid on a substrate S (shown in phantom). The controller 102 may additionally be coupled to a host computer 122 for receiving image and other data and to a power supply 124 for generating amplified firing pulses.

In the embodiment shown, the host computer 122 is coupled to a stage controller 126 that may provide XY (e.g., horizontal and vertical) move commands to position the substrate S relative to the print heads 110, 112, 114. For example, the stage controller 126 may control one or more motors 128 to move a stage 129 that supports the substrate S. One or more encoders 130 may be coupled to the motors 128 and/or the stage 129 to provide motion feedback to the stage controller 126 which in turn may be coupled to the controller 102 to provide a signal that may be used to track the position of substrate S relative to the print heads 110, 112, 114. In some embodiments, a real time controller 132 may also be coupled to the controller 102 to provide a jet enable signal for enabling deposition of ink (or other fluid) as described further below. Although a connection is not pictured, the real time controller 132 may receive signals from the stage controller 126 and/or the encoders 130 in order to determine when the jet enable signal is to be asserted in some embodiments.

The controller 102 may be implemented using one or more field programmable gate arrays (FPGA) or other similar devices. In some embodiments, discrete components may be used to implement the controller 102. The controller 102 may be adapted to control and/or monitor the operation of the inkjet print system 100 and one or more of various electrical and mechanical components and systems of the inkjet print system 100 which are described herein. In some embodiments, the controller 102 may be any suitable computer or computer system, or may include any number of computers or computer systems.

In some embodiments, the controller 102 may be or may include any components or devices which are typically used by, or used in connection with, a computer or computer system. Although not explicitly pictured in FIG. 1, the controller 102 may include a central processing unit(s), a read only memory (ROM) device and/or a random access memory (RAM) device. The controller 102 may also include an input device such as a keyboard and/or a mouse or other pointing device, an output device such as a printer or other device via which data and/or information may be obtained, and/or a display device such as a monitor for displaying information to a user or operator. The controller 102 may also include a transmitter and/or a receiver such as a LAN adapter or communications port for facilitating communication with other system components and/or in a network environment, one or more databases for storing any appropriate data and/or information, one or more programs or sets of instructions for executing methods of the present invention, and/or any other computer components or systems, including any peripheral devices.

According to some embodiments of the present invention, instructions of a program may be read into a memory of the controller 102 from another medium, such as from a ROM device to a RAM device or from a LAN adapter to a RAM device. Execution of sequences of the instructions in the program may cause the controller 102 to perform one or more of the process steps described herein. In alternative embodiments, hard-wired circuitry or integrated circuits may be used in place of, or in combination with, software instructions for implementation of the processes of the present invention. Thus, embodiments of the present invention are not limited to any specific combination of hardware, firmware, and/or software.

As indicated above, the controller 102 may generate, receive, and/or store databases including data related to images to be printed, substrate layout data, print head calibration/drop displacement data, and/or substrate positioning and offset data. As will be understood by those skilled in the art, the schematic illustrations and accompanying descriptions of the sample data structures and relationships presented herein are exemplary arrangements for stored representations of information. Any number of other arrangements may be employed besides those suggested by the illustrations provided.

The drivers 104, 106, 108 may be embodied as a portion or portions of the controller's 102 logic as represented in FIG. 1A. In alternative and/or additional embodiments, the drivers 104, 106, 108 may embody the entire controller 102 or the drivers 104, 106, 108 may be embodied as separate analog and digital circuits coupled to, but independent of, the controller 102. As pictured, each of the drivers 104, 106, 108 may be used to drive a corresponding print head 110, 112, 114. In some embodiments, one driver 104 may be used to drive all the print heads 110, 112, 114. The drivers 104, 106, 108 may be used to send data and clock signals to the corresponding print heads 110, 112, 114. In addition, the drivers 104, 106, 108 may be used to send firing pulse voltage signals to the corresponding print heads 110, 112, 114 to trigger individual nozzles of the print heads 110, 112, 114 to deposit specific quantities of ink or other fluid onto a substrate.

The drivers 104, 106, 108 may each be coupled directly to the power supply 118 so as to be able to generate a relatively high voltage firing pulse to trigger the nozzles to "jet" ink. In some embodiments, the power supply 118 may be a high voltage negative power supply adapted to generate signals having an amplitude of approximately 140 volts or more. Other voltages may be used. The drivers 104, 106, 108 may, under the control of the controller 102, send firing pulse voltage signals with specific amplitudes and durations so as to cause the nozzles of the print heads to dispense fluid drops of specific drop sizes as described, for example, in previously incorporated U.S. patent application Ser. No. 11/061,120, Attorney Docket No. 9769.

The print heads 110, 112, 114, may each include any number of nozzles 116, 118, 120. In some embodiments, each print head 110, 112, 114 may include one hundred twenty eight nozzles that may each be independently fired. An example of a commercially available print head suitable for used with the present invention is the model SX-128, 128-Channel Jetting Assembly manufactured by Spectra, Inc. of Lebanon, N.H. This particular jetting assembly includes two electrically independent piezoelectric slices, each with sixty-four addressable channels, which are combined to provide a total of 128 jets. The nozzles are arranged in a single line, at a 0.020" distance between nozzles. The nozzles are designed to dispense drops from 10 to 12 picoliters but may be adapted to dispense from 10 to 30 picoliters. Other print heads may also be used.

Figure 1B:
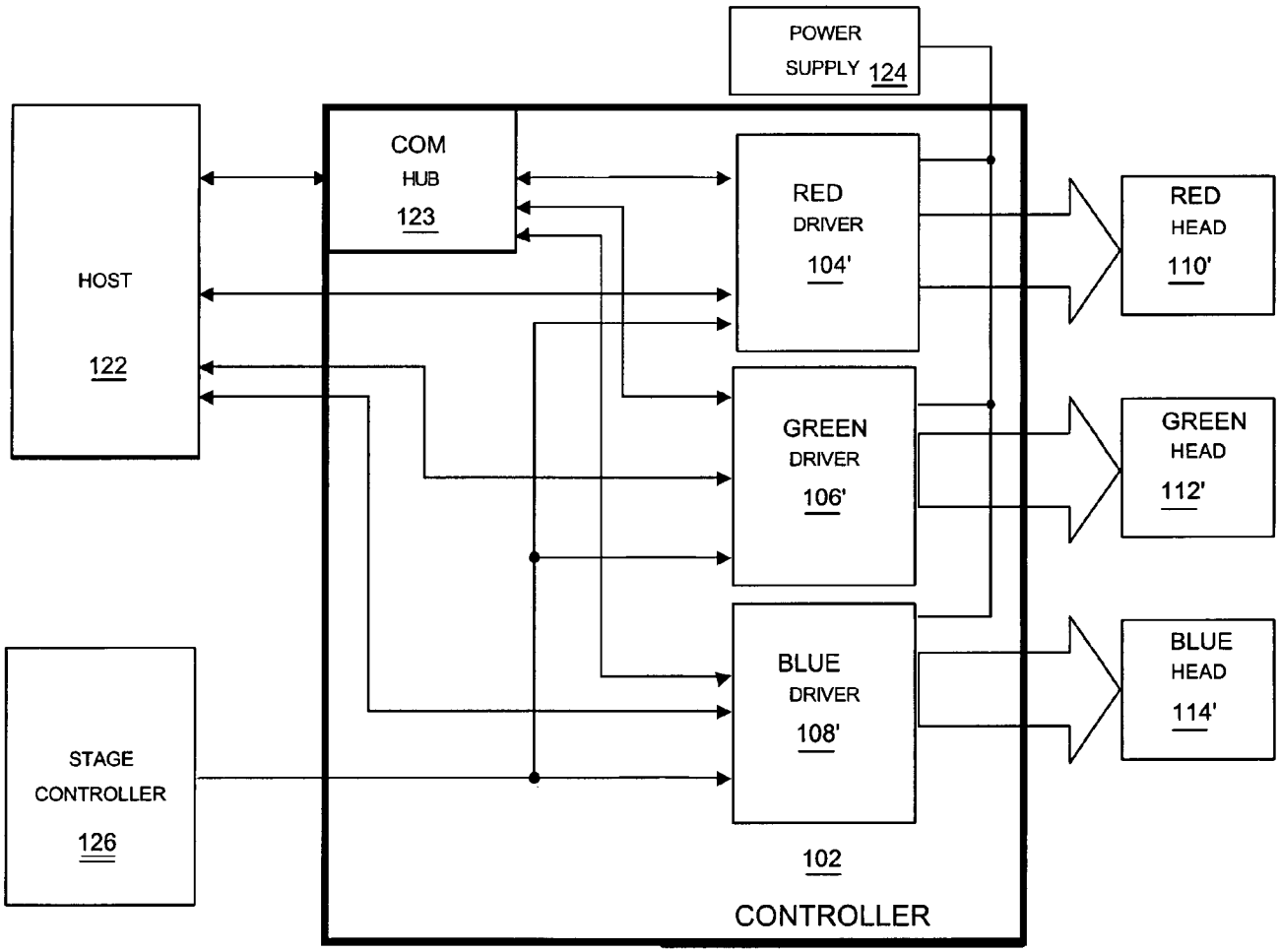
FIG. 1B is a schematic illustration depicting details of a controller as represented in FIG. 1A according to some embodiments of the present invention.

Turning to FIG. 1B, a schematic illustration is provided depicting details of example connections within an embodiment of the controller of FIG. 1A. In a specific example embodiment, the controller 102 may drive, in parallel, three differently colored print head assemblies: Red 110', Green 112', and Blue 114' (RGB). In some embodiments, each print head 110', 112', 114' in the inkjet printing system 100 may be driven by a separate driver 104', 106', 108'. For example, each print head 110', 112', 114' may be coupled to a driver 104', 106', 108', respectively, of the controller 102. In some embodiments, particularly where the drivers 104', 106', 108' are connected in parallel, a processor controlled communication hub 123 may be used to manage and optimize image data downloads from the host 122 to the drivers 104', 106', 108' so that the correct data is delivered to the correct driver 104', 106', 108'. Each print head/driver assembly may be assigned a unique media access control (MAC) and transmission control protocol/internet protocol (TCP/IP) addresses so that the processor controlled communication hub 123 may properly direct appropriate portions of the image data. Thus, the host 122 and the drivers 104', 106', 108' may each communicate directly via communications links, such as, for example, via Ethernet. In such embodiments, the controller 102 (or the system 100) may include an Ethernet switch-based communications hub 123, implemented using, for example, a model RCM3300 processor board manufactured by Rabbit Semiconductor of Davis, Calif. The drivers 104', 106', 108' may thus include communications adapters such as Ethernet LAN devices. In some embodiments, the Ethernet LAN devices and other communications facilities may be implemented using, for example, an FPGA within the logic of the drivers 104', 106', 108'.

The drivers 104', 106', 108' may be adapted to control the print heads based on pixel data as discussed above. Each driver 104', 106', 108' may be coupled to each print head 110', 112', 114' via, for example, a one-way 128 wire-path flat ribbon cable (represented by block arrows in FIG. 1B) so that each nozzle may receive a separate fire pulse. As mentioned above, power supply 124 may be coupled to each of the drivers 104', 106', 108'. The stage controller 126 may be coupled to each of the drivers 104', 106', 108' via a one or two-way communications bus to provide substrate position or other information as mentioned above. For example, an RS485 communications path may be used. Thus, the drivers 104', 106', 108' may include appropriate logic to connect to and communicate via an RS485 bus. In various embodiments, the host 122 may include multiple two-way communications connections to the drivers 104', 106', 108'. The host 122, which may, for example, be implemented using a VME workstation capable of real time processing, may transmit the relevant portions of the image or pixel data directly to the respective drivers 104', 106', 108' via, for example, individual RS232 serial communications paths. Thus, the drivers 104', 106', 108' may include appropriate logic to connect to and communicate via RS232 serial lines.

Figure 1C:
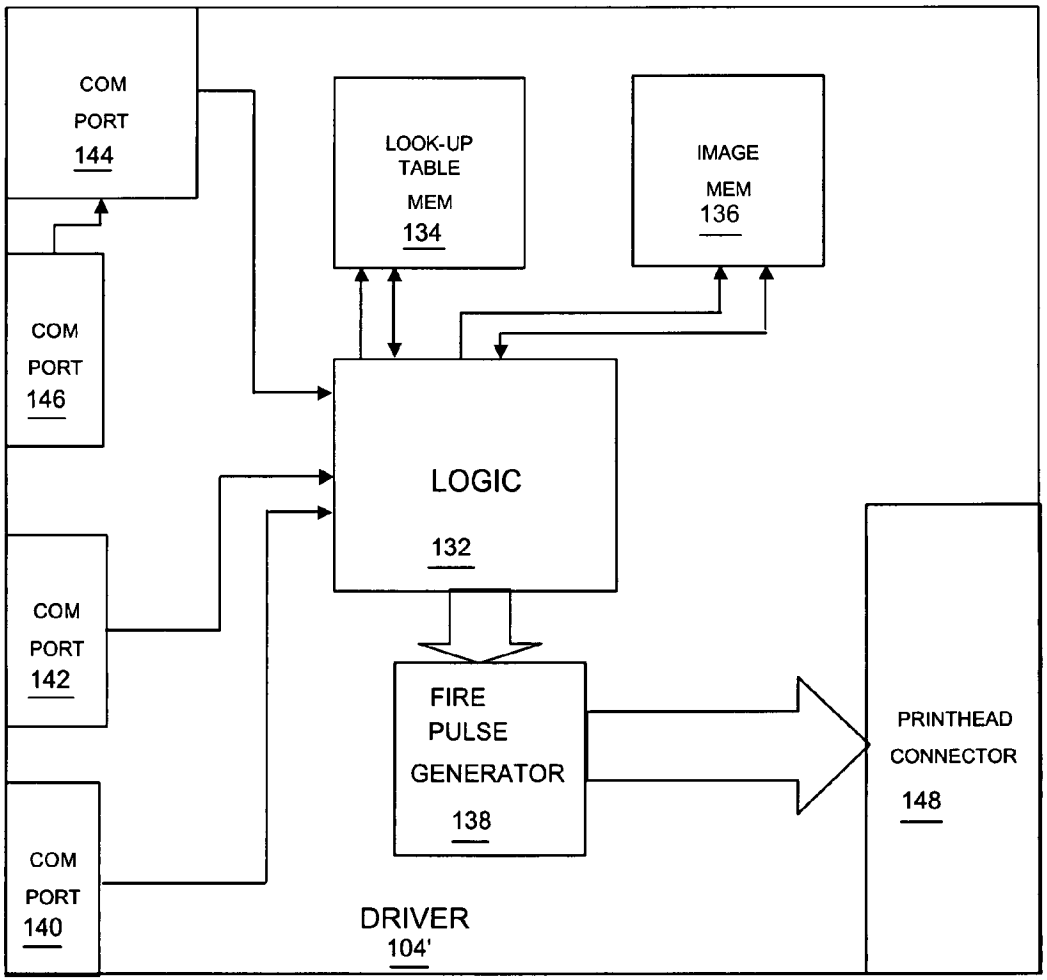
FIG. 1C is a schematic illustration depicting a driver as represented in FIG. 1B according to some embodiments of the present invention.

Turning to FIG. 1C, a schematic illustration is provided depicting example details of a representative driver 104' as shown in FIG. 1B. Logic 132 is coupled to look-up table memory 134 and image memory 136. In some embodiments, a single memory may be used or, alternatively, three or more memories may be employed. Logic 132 is also coupled to a fire pulse generator circuit 183 and communications ports 140, 142, 144. In some embodiments, the driver 104' may additionally include communications port 146 that is connected to communications port 144. The fire pulse generator 138 is connected to print head connector 146 which provides means to connect, for example, a ribbon cable to the corresponding print head 110'.

The logic 132 of diver 104' (and each of drivers 106', 108') may be implemented using one or more FPGA devices that each include an internal processor, for example, the Spartan™-3E Series FPGAs manufactured by Xilinx®, Inc. of San Jose, Calif. In some embodiments, the logic 132 may include four identical 32-jet-control-logic segments (e.g., each of the four segments implemented on one of four Spartan™-3E Series FPGAs) to drive, for example, the 128 inkjet nozzles of a print head (e.g., the model SX-128, 128-Channel Jetting Assembly mentioned above). Either or both of the look-up table memory 134 and the image memory 136 may be implemented using flash or other memory devices.

In operation, the image memory 136 may store pixel and/or image data that the logic 132 uses to create logic level signals that are sent to the fire pulse generator 138 to trigger actual fire pulses that are sent to activate piezoelectric elements in the print head nozzles to dispense ink. The look-up table memory 134 may store data from predetermined, correction lookup tables (e.g., determined during a calibration process) that may be used by the logic 132 to adjust the pixel data. In some embodiments, 16 bits (e.g., a 16-bit resolution) may be used to define the fire pulse amplitude sent to each piezoelectric element in the print head assembly. The fire pulse amplitude may be used to indicate the amount of ink (e.g., drop size) to be deposited per jetting action. Using 16 bits to specify the fire pulse amplitude allows the controller 102 to have a 0.5 Pico-liter drop resolution. Thus, sixteen bits of fire pulse amplitude data may be stored for each nozzle or for each drop location specified in the pixel data. Likewise, space in the look-up table memory 134 may be reserved for drop placement accuracy/corrections either on a per nozzle basis or on a per drop location basis. In addition to the look-up table memory 134 and the image memory 136, the logic 132 may include internal processor memory that may be used to interpret commands sent by the host 122, configure a gate array within the logic 132, and manage storage of data into the memories 134, 136 which may be, e.g., flash memories. As indicated above, the driver 104' generates the logic level pulses which encode the desired length and amplitude of the fire pulse. At the appropriate time (e.g., based on the position of the print head relative to a target pixel well), the logic level signals are individually sent to the fire pulse generator 138 which in response releases actual fire pulses to activate each of the inkjet nozzles 116 (FIG. 1A) of a print head 110 (FIG. 1A).

The fire pulse generator 138, which generates the fire pulses for the piezoelectric elements of the print head, may, for example, be connected to the logic 132 and interfaced with the print head via a flat ribbon cable having an independent path for each logic level and fire pulse signal corresponding to each separate nozzle. These ribbon cables are represented in FIG. 1C by block arrows.

Figure 1D:
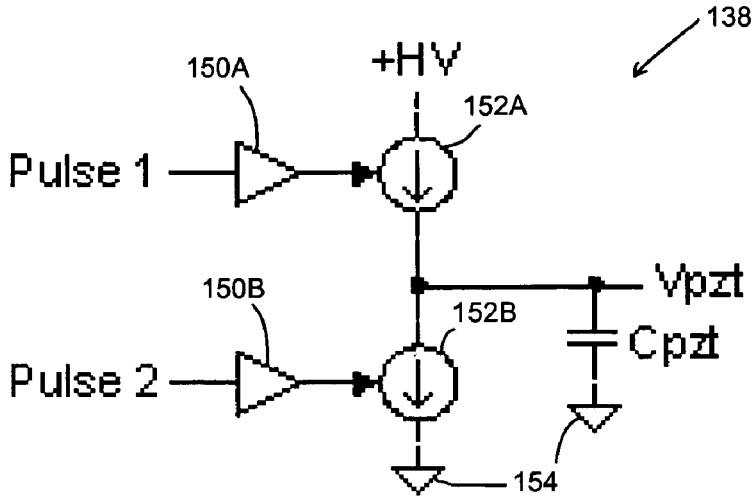
FIG. 1D is a partial schematic illustration depicting a fire pulse generator circuit as represented in FIG. 1C according to some embodiments of the present invention.

Turning to FIG. 1D, a partial schematic illustration is provided depicting example details of a fire pulse generator circuit of FIG. 1C for one inkjet nozzle. The fire pulse generator circuit 138 includes two input switches 150A, 150B that are coupled to and control current sources 152A, 152B, respectively. In some embodiments, the two input switches 150A, 150B may be the transistor-based and/or the current sources 152A, 152B may be implemented, for example, using switching mode field effect transistors (FETs). Current source 152A is coupled to a high voltage supply HV and current source 152B is coupled to ground 154. Both current sources 152A, 152B are also coupled to a line that leads to the piezoelectric element $C_{pzt}$ (represented by a capacitor) of an individual inkjet nozzle. Note that although piezoelectric element $C_{pzt}$ is shown as part of the fire pulse generator circuit 138 for illustrative purposes, the piezoelectric element $C_{pzt}$ is actually out in the inkjet nozzles 116 (FIG. 1A) of a print head 110 (FIG. 1A).

Figure 1E:
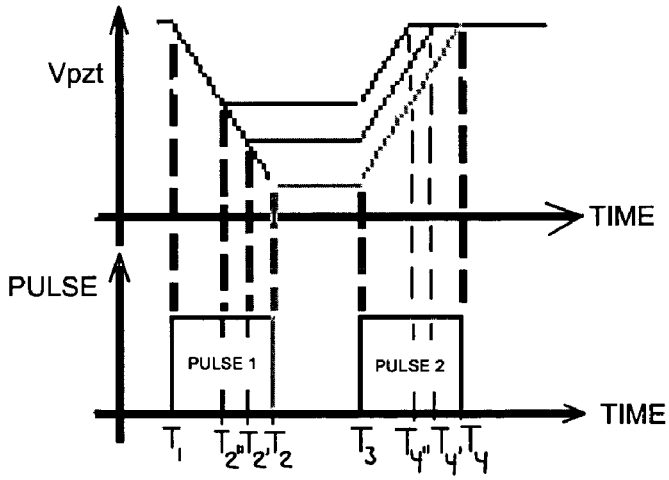
FIG. 1E is a graph depicting the voltage signal generated by the fire pulse generator circuit as shown in FIG. 1D according to some embodiments of the present invention.

Turning to FIG. 1E, a graph is provided depicting the voltage signal generated by a fire pulse generator circuit 138 shown in FIG. 1D in response to input pulses from the logic 132 (FIG. 1C). In operation, a first logic level pulse received from logic 132 at input switch 150A causes input switch 150A to turn on current source 152A at $T_1$ which charges up piezoelectric element $C_{pzt}$ (which electrically acts like a capacitor). Once the first logic level pulse ends at $T_2$, input switch 150A turns off current source 152A. When a second logic level pulse from logic 132 is received at input switch 150B at $T_3$, current source 152B is turned on and begins to discharge piezoelectric element $C_{pzt}$. Once the second logic level pulse ends at time $T_4$, input switch 150B turns off current source 152B.

As indicated above, the fire pulse generator circuit 138 uses a fixed-current source and transistors operated in a switching mode to control the charging and discharging events of a piezoelectric element $C_{pzt}$. As shown in FIG. 1E, the fixed-current source based circuit 138 generates a trapezoidal shaped fire pulse signal that varies linearly with time during charging and discharging, e.g., $[V_{pzt}(t)=(I_o/C)t]$. This feature is useful in controlling the drop size resolution, particularly during printing. For example, by varying the pulse width of the logic level signals from logic 132 (FIG. 1C), the amplitude of $V_{pzt}$ can be precisely controlled which directly controls the ink drop size jetted by the piezoelectric element $C_{pzt}$. More specifically, by moving the ending transition (logic high to low) of the logic level signal Pulse 1 to $T_2'$ (instead of $T_2$) and logic level signal Pulse 2 to $T_4'$ (instead of $T_4$), the amplitude of $V_{pzt}$ is reduced and less ink is jetted. Likewise, by moving the ending transition of Pulse 1 to $T_2''$ (instead of $T_2'$) and logic level signal Pulse 2 to $T_4''$ (instead of $T_4'$), the amplitude of $V_{pzt}$ is even further reduced and even less ink is jetted.

In contrast to the fixed current-based fire pulse generator circuit 138, a variable current RC-based circuit, in which the voltage varies exponentially with time, $[V=V_{HV}(1-e^{-t/RC})$, where $V_{HV}$ is the raw DC supply voltage], has a variable slew rate and drop size resolution that is hard to control while the system 100 is printing. An example of such an RC-based circuit and non-linear fire pulse signal are described below with respect to FIGS. 3A to 3D.

Figure 2A:
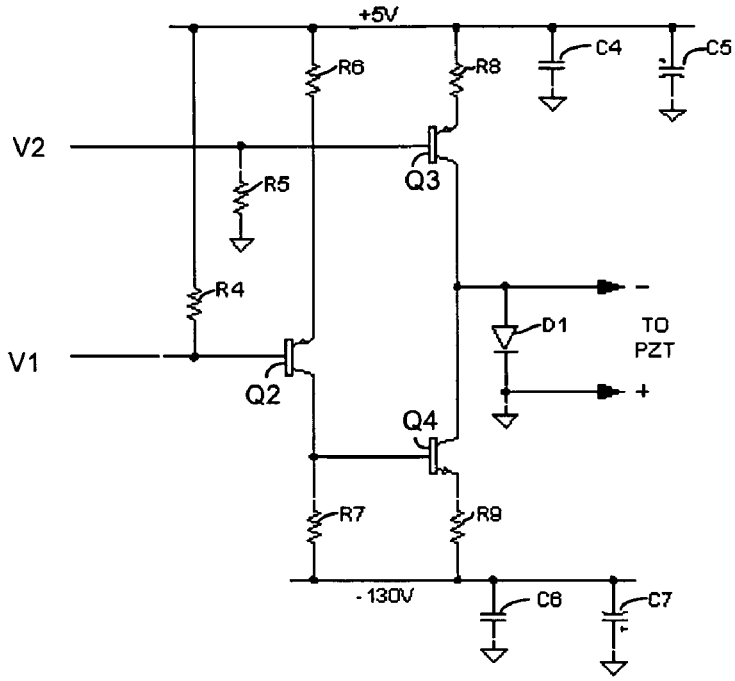
FIG. 2A is a more detailed partial schematic illustration depicting the details of the fire pulse generator circuit of FIG. 1D according to some embodiments of the present invention.

Turning to FIG. 2A, a more detailed partial schematic illustration is provided showing the details of an example embodiment of the fire pulse generator circuit 138 of FIG. 1D. Note that the schematic depicts an example of only one fire pulse generator for a single nozzle and that a complete fire pulse generator circuit would include many such fire pulse generators, each one corresponding to one of the plurality of nozzles in a print head. Also note that the particular topology and components of the circuit shown in FIG. 2A and described herein are merely exemplary. Other topologies and components may be used to generate fire pulse signals that have constant slew rates.

Terminals V1 and V2 are input terminals that are coupled to the gates of transistors Q2 and Q3 respectively. Transistors Q2 and Q3 may be implemented using, for example, a model 2N5401 PNP field effect transistor (FET) available from Fairchild Semiconductor of South Portland, Me. V1 is also coupled to a resistor R4 which is coupled to a +5V supply. V2 is also coupled to a resistor R5 which is coupled to ground. Both R4 and R5 may be approximately 100 KΩ. The source terminals of transistors Q2 and Q3 are coupled to resisters R6 and R8, respectively. Resisters R6 and R8 may be approximately 2 KΩ and 442Ω, respectively and are also coupled to the +5V supply. The drain terminal of transistor Q2 is connected to both the gate terminal of transistor Q4 and a resistor R7 which leads to a negative 130V supply. Transistor Q4 may be implemented using, for example, a model 2N5551 NPN field effect transistor also available from Fairchild Semiconductor. Resistor R7 may be approximately 2 KΩ. The source terminal of transistor Q4 is coupled to a resister R9 which is coupled to the negative 130V supply and may be approximately 442Ω. The drain terminals of transistors Q3 and Q4 are coupled together to form the negative terminal −PZT for the piezoelectric element $C_{PZT}$ (FIG. 1D). The positive terminal +PZT for the piezoelectric element $C_{PZT}$ (FIG. 1D) is coupled to ground and to a diode D1 which is also coupled to the negative terminal −PZT for the piezoelectric element $C_{PZT}$ (FIG. 1D). Diode D1 may be implemented using a model BAS20 Small Signal Diode, also available from Fairchild Semiconductor. Capacitors C4 and C5 are coupled between the +5V supply and ground. Capacitors C4 and C5 may be rated approximately 0.22 μF, 16V and 10 μF, 10V, respectively. Likewise, capacitors C6 and C7 are coupled between the negative 130V supply and ground. Capacitors C6 and C7 may be rated approximately 0.1 μF, 200V and 10 μF, 2000V, respectively.

Figure 2B:
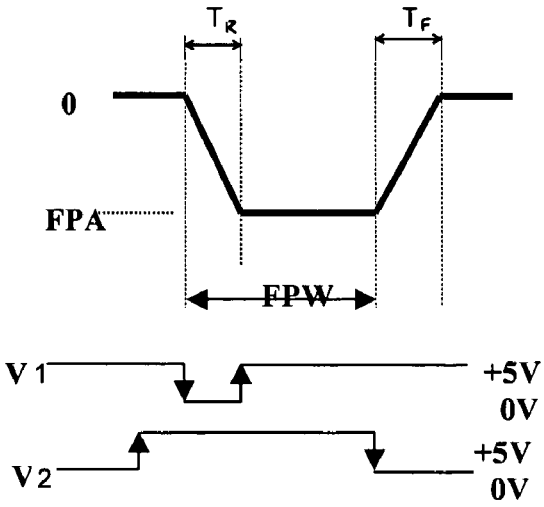
FIG. 2B is a graph of a fire pulse output by the fire pulse generator circuit of FIG. 2A and an associated timing diagram depicting the corresponding logic level inputs to the fire pulse generator circuit of FIG. 2A according to some embodiments of the present invention.

FIG. 2B is a graph of a fire pulse output by the fire pulse generator circuit of FIG. 2A and an associated timing diagram depicting the corresponding logic level voltage signal V1 and V2 inputs to the fire pulse generator circuit of FIG. 2A.

Instead of using an RC variable current source to control the charging of a print head piezoelectric element $C_{pzt}$ (FIG. 1D) coupled to the +/−PZT terminals (FIG. 2A), the present invention uses a fixed current source circuit to control a charge and a discharge profile of a generated fire pulse across the piezoelectric element $C_{pzt}$ (FIG. 1D) as shown in FIG. 2A. Since the current is fixed with time, the fire pulse voltage is linearly proportional with time, as shown in the graph of the fire pulse voltage of FIG. 2B. Therefore, the fixed current source generates a fire pulse with linear charge (e.g., during $T_R$) and discharge (e.g., during $T_F$) edges during the charging and discharging time of the piezoelectric element $C_{pzt}$ (FIG. 1D) of the print head 110 (FIG. 1A). As a result, the slew rate is fixed, therefore, so is the resolution. As shown in the example circuit of FIG. 2A, switching mode FETs can be made to act like fixed current sources. Discharge time $T_F$ of the current source based fire pulse generator circuit can be set similar to charge time $T_R$, which is another advantage over an RC-based circuit.

Operation of the fixed current source is governed by the following equations:

$$dq(t)=I_o dt$$

$$V_c(t)=(I_o/C)t$$

In operation, when logic level signal V1 is at +5V (e.g., Logic High) and V2 is at 0V (e.g., Logic Low) the status of the circuit's transistors are as follows: FET Q3 is ON, FET Q2 is OFF, and FET Q4 is OFF. Under these conditions, current from the piezoelectric element $C_{PZT}$ passes through and discharges any stored charge of electrons through the +5V supply. However, when V2 switches status from 0V to +5V (e.g., Low to High signal received from logic 132 of FIG. 1C), FET Q3 turns off. The voltage across the piezoelectric element $C_{PZT}$ stays at 0V until the leading edge of V1 pulse switches from +5V to 0V (High to Low) turning on PNP FET Q2 and, subsequently, NPN FET Q4.

Under such conditions, a potential difference between the gate and source of transistor Q4 causes current to flow backward from the negative 130V power supply charging the piezoelectric element $C_{PZT}$ negatively. The charging continues for a length of time equal to the V1 pulse width. Once V1 switches back to active High, the charging stops, and the voltage across the piezoelectric element $C_{PZT}$ is held constant for the period of time determined by the width of the V2 pulse. When V2 changes status from High to Low, it enables FET Q3 again allowing the charge stored in the piezoelectric element $C_{PZT}$ to drain away. In order to ensure that the piezoelectric element $C_{PZT}$ discharges to approximately 0V, a clamping diode D1 is used and the product of I×dt during discharging is set larger than that during charging. The net effect is the generation of an output fire pulse having an adjustable amplitude FPA and a width FPW that spans from the falling transition of input V1 (e.g., the start of the charging of piezoelectric element $C_{PZT}$) to the falling transition of input V2 (e.g., the start of the discharging of piezoelectric element $C_{PZT}$).

Figure 3A:
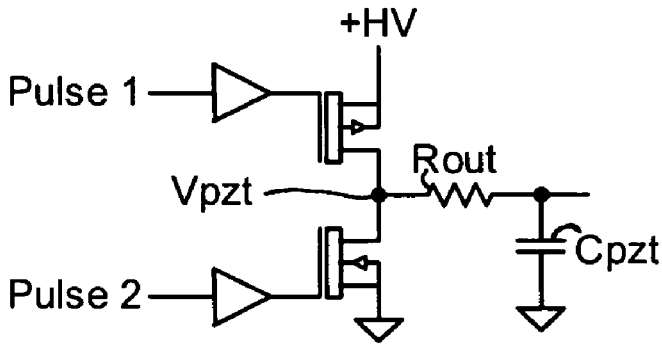
FIG. 3A is a partial schematic illustration depicting a fire pulse generator circuit according to the prior art.

FIG. 3A is a partial schematic illustration depicting a fire pulse generator circuit according to the prior art. The common method adopted in the inkjet industry to generate the fire pulse (FP) profile and amplitude is to charge each piezoelectric element in a print head assembly using either one common driver or separate drivers based on an RC-capacitive load charging and discharging technique. This technique produces an irregularly shaped signal profile, in which the rising and falling edges of the fire pulse are not linear with time as described below and shown in FIG. 3B. As a result, the slew rate produced using this method varies with time due to variation of current flowing across the RC circuit. This method makes the process of adjusting fire pulse amplitude to produce a variable drop size while printing very difficult and time consuming and thus, may significantly negatively impact overall print system throughput.

Figure 3B:
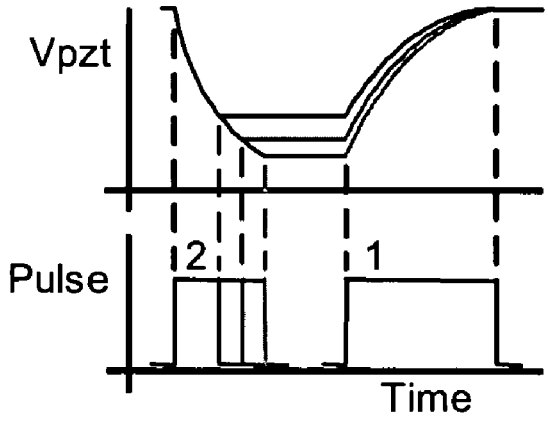
FIG. 3B is a graph depicting the voltage signal generated by the fire pulse generator circuit shown in FIG. 3A.
Figure 3C:
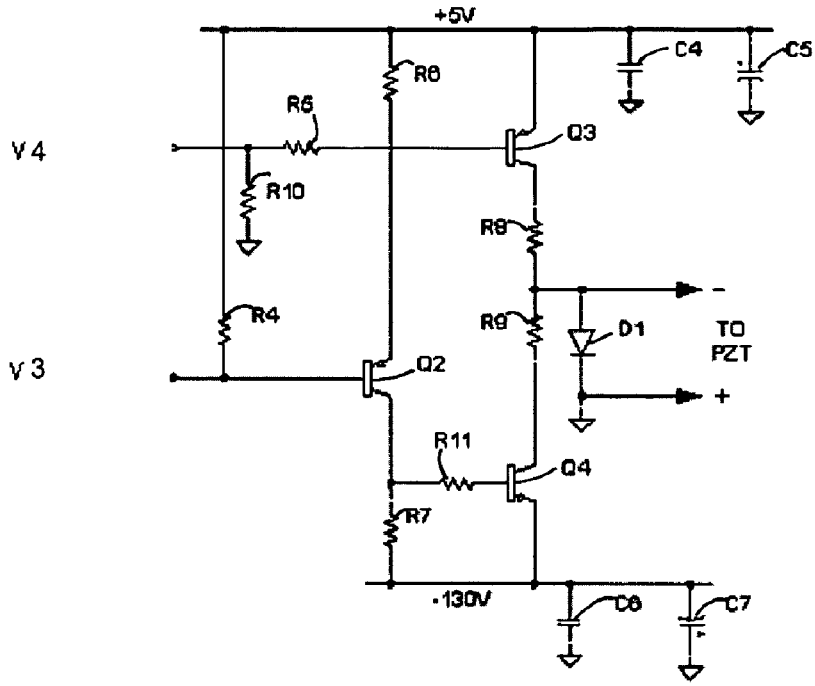
FIG. 3C is a more detailed partial schematic illustration depicting the details of the prior art fire pulse generator circuit of FIG. 3A.
Figure 3D:
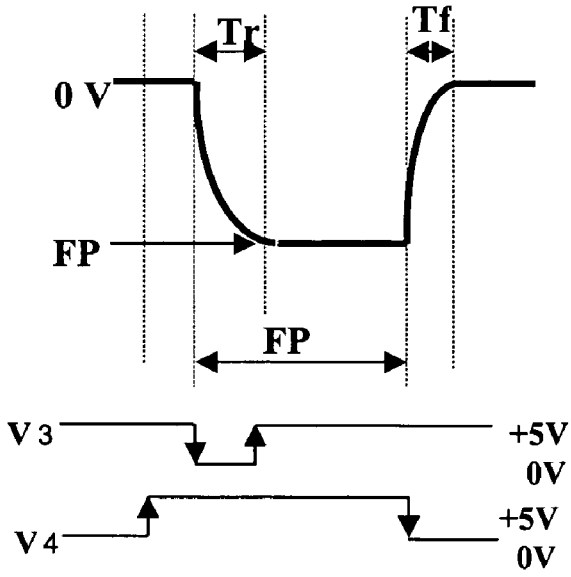
FIG. 3D is a graph of a fire pulse output by the fire pulse generator circuit of FIG. 3C and an associated timing diagram depicting the corresponding logic level inputs to the fire pulse generator circuit of FIG. 3C.

FIG. 3B is a graph depicting the voltage signal generated by the fire pulse generator circuit shown in FIG. 3A. Note that the fire pulse amplitude changes disproportionately as the width of Pulse 2 is changed. FIG. 3C is a more detailed partial schematic illustration depicting the details of an example embodiment of the prior art fire pulse generator circuit of FIG. 3A. FIG. 3D is a graph of a fire pulse output by the fire pulse generator circuit of FIG. 3C and an associated timing diagram depicting the corresponding logic level inputs to the fire pulse generator circuit of FIG. 3C.

The non-linearity of the RC circuit is caused by the variability of the current across the resistor (resistor R9 during charging and resistor R8 during discharging) with time. During charging, the governing equation that described the voltage drop $V_C$ and $V_R$ across the print head piezoelectric element capacitive load in series with resistive load R9 is given by the following equations:

$$V_{HV}=V_R(t)+V_C(t)$$

$$V_{HV}=I(t)R+q(t)$$

$$V_{HV}=dq(t)/dt+q(t)/C$$

The solution to this differential equation is:

$$q(t)=C\,V_{HV}(1-e^{-t/RC})$$

$$V_C=V_{HV}(1-e^{-t/RC})$$

Where $V_{HV}$ is the raw DC supply voltage.

Similarly, the voltage across the piezoelectric element capacitive load during discharging is given by:

$$-I(t)R-q(t)/C=0$$

$$dq(t)/dt=-q(t)/RC$$

$$q(t)=q_o e^{-t/RC}$$

$$V_c(t)=q_o/C\,e^{-t/RC}$$

The foregoing description discloses only particular embodiments of the invention; modifications of the above disclosed methods and apparatus which fall within the scope of the invention will be readily apparent to those of ordinary skill in the art. For example, the present invention may also be applied to spacer formation, polarizer coating, and nanoparticle circuit forming.

Accordingly, while the present invention has been disclosed in connection with specific embodiments thereof, it should be understood that other embodiments may fall within the spirit and scope of the invention, as defined by the following claims.

The invention claim is:

1. An apparatus for generating a fire pulse comprising:

a first input adapted to receive a first control signal;

a second input adapted to receive a second control signal;

a first component coupled to and controlled by the first input, the first component comprising at least a first transistor, at least one first capacitor, and at least one first resistor selected to enable the first component to function as a first fixed current source;

a second component coupled to and controlled by the second input, the second component comprising at least a second transistor, at least one second capacitor, and at least one second resistor selected to enable the second component to function as a second fixed current source;

an output terminal coupled to the first transistor and to the second transistor;

wherein the first component is adapted to charge a piezoelectric element coupled to the output terminal at a constant rate in response to a state of the first input; and wherein a slew rate of a charge signal generated by the first component is constant.

2. The apparatus of claim 1 wherein the output terminal is adapted to be coupled to a piezoelectric element of an inkjet print head.

3. The apparatus of claim 1 wherein the first and second inputs are adapted to receive logic level control signals indicative of a drop size.

4. The apparatus of claim 1 wherein the second component is adapted to discharge a piezoelectric element coupled to the output terminal in response to a state of the second input.

5. The apparatus of claim 4 wherein a slew rate of a discharge signal generated by the second component is constant.

6. The apparatus of claim 1 wherein an amplitude of a fire pulse generated by the apparatus is linearly related to drop size information represented by the first and second control signals.

7. A system for generating a fire pulse comprising:

logic including a processor;

a memory coupled to the logic; and a fire pulse generator circuit coupled to the logic and including:

a first input adapted to receive a first control signal from the logic;

a second input adapted to receive a second control signal from the logic;

a first component coupled to and controlled by the first input, the first component comprising at least a first transistor, at least one first capacitor, and at least one first resistor selected to enable the first component to function as a first fixed current source;

a second component coupled to and controlled by the second input, the second component comprising at least a second transistor, at least one second capacitor, and at least one second resistor selected to enable the second component to function as a second fixed current source;

an output terminal coupled to the first transistor and to the second transistor;

wherein the first component is adapted to charge a piezoelectric element coupled to the output terminal at a constant rate in response to a state of the first input; and wherein a slew rate of a charge signal generated by the first component is constant.

8. The system of claim 7 wherein the output terminal is adapted to be coupled to a piezoelectric element of an inkjet print head.

9. The system of claim 7 wherein the first and second inputs are adapted to receive logic level control signals indicative of a drop size.

10. The system of claim 7 wherein the second component is adapted to discharge a piezoelectric element coupled to the output terminal in response to a state of the second input.

11. The system of claim 10 wherein a slew rate of a discharge signal generated by the second component is constant.

12. The system of claim 7 wherein an amplitude of a fire pulse generated by the apparatus is linearly related to drop size information represented by the first and second control signals.

13. A method of generating a fire pulse comprising:

receiving a first control signal at a first input;

receiving a second control signal at a second input;

controlling a first component coupled to the first input in response to the first control signal, the first component comprising at least a first transistor, at least one first capacitor, and at least one first resistor selected to enable the first component to function as a first fixed current source;

controlling a second component coupled to the second input in response to the second control signal, the second component comprising at least a second transistor, at least one second capacitor, and at least one second resistor selected to enable the second component to function as a second fixed current source;

outputting a fire pulse to an output terminal coupled to the first transistor and to the second transistor;

wherein controlling a first component includes charging a piezoelectric element coupled to the output terminal at a constant rate in response to a state of the first input; and wherein charging a piezoelectric element includes generating a charge signal having a constant slew rate.

14. The method of claim 13 wherein outputting a fire pulse to an output terminal includes transmitting the fire pulse to a piezoelectric element of a inkjet print head coupled to the output terminal.

15. The method of claim 13 wherein receiving the first and second control signals includes receiving logic level control signals indicative of a drop size.

16. The method of claim 13 wherein controlling a second component includes discharging a piezoelectric element coupled to the output terminal in response to a state of the second input.

17. The method of claim 16 wherein discharging a piezoelectric element includes generating a discharge signal having a constant slew rate.

18. The method of claim 13 wherein an amplitude of a fire pulse generated by the apparatus is linearly related to drop size information represented by the first and second control signals.

* * * * *

UNITED STATES PATENT AND TRADEMARK OFFICE

CERTIFICATE OF CORRECTION

PATENT NO. : 7,637,580 B2
APPLICATION NO. : 11/238637
DATED : December 29, 2009
INVENTOR(S) : Shamoun et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 337 days.

Signed and Sealed this

Ninth Day of November, 2010

David J. Kappos

David J. Kappos
*Director of the United States Patent and Trademark Office*